US006883554B2

(12) United States Patent
Baumann et al.

(10) Patent No.: US 6,883,554 B2
(45) Date of Patent: Apr. 26, 2005

(54) HEDDLE DAMPING SYSTEM

(75) Inventors: Hans Baumann, Horgen (CH); Franz Mettler, Wollerau (CH)

(73) Assignee: Grob Horgen AG (CH)

( * ) Notice: Subject to any disclaimer, the term of this patent is extended or adjusted under 35 U.S.C. 154(b) by 120 days.

(21) Appl. No.: 10/364,415

(22) Filed: Feb. 12, 2003

(65) Prior Publication Data

US 2003/0150506 A1 Aug. 14, 2003

(30) Foreign Application Priority Data

Feb. 14, 2002 (DE) ..... 102 06 130

(51) Int. Cl.[7] ..... D03C 9/02
(52) U.S. Cl. ..... 139/93
(58) Field of Search ..... 139/53, 92–96

(56) References Cited

U.S. PATENT DOCUMENTS 6,009,918 A * 1/2000 Beyaert ..... 139/92
6,213,162 B1 * 4/2001 Baechtold ..... 139/93
6,230,756 B1 * 5/2001 Baumann et al. ..... 139/93
6,446,676 B1 * 9/2002 Magri et al. ..... 139/92

FOREIGN PATENT DOCUMENTS

| | | |
|---|---|---|
| DE | 199 62 977 | 9/2001 |
| WO | WO 97/26396 | 7/1997 |

* cited by examiner

*Primary Examiner*—John J. Calvert
*Assistant Examiner*—Shaun R Hurley
(74) *Attorney, Agent, or Firm*—Dykema Gossett PLLC

(57) ABSTRACT

A loom shaft for a heddle has two end eyes in which at least one eye is elongated in the longitudinal direction of the heddle such that even during operation and bending of the shaft in the region of the shaft center, the distance between an inner rail edge of the heddle support rail and the region of the cutout end of the eye and the outer rail edge of the opposite heddle support rail is greater than the distance between the inner stop of the cutout end eye and the outer stop of the opposite end eye. The inner edge facing the heddle support rail may be of elastic material on at least one support bar of the shaft to prevent impact of heddles against the support bar during high stress placed on the shafts.

14 Claims, 5 Drawing Sheets

HEDDLE DAMPING SYSTEM

BACKGROUND OF THE INVENTION

This invention relates generally to a loom shaft comprising a heddle frame of upper and lower support bars, upper and lower heddle support rails attached to the support bars, a plurality of heddles lined up on the heddle support rails, and more particularly to a damping system for the heddles of the loom shaft permitting proper operation even at high weaving machine speeds and with loom shafts of traditional design.

Stress increases significantly on loom shafts with increased speed of the weaving machines. This has great impact on the heddles lined up on the heddle support rails of the loom shaft. In some instances conditions have now been reached in which traditional systems of shafts and heddles are no longer operationally satisfactory. It is, however, possible to manufacture the loom shafts at economically reasonable costs to withstand increases in mechanical stress. The standardized shape and tolerance between heddles and shafts or the elements of the shafts supporting the heddles, or the heddle support rails are such that a greater amount of wear occurs on the heddle support rails and the heddles themselves. After a very short time, this leads to failure of the heddles, for example, by breaking off at the end eyes. The shafts are often thereby damaged. In any case, production stops and faults in the woven textile occur as the result of such breaks in the heddles.

There are two approaches disclosed that offer a solution to the aforementioned problem. International application WO 97/26396 discloses the insertion of damping elements parallel to the heddle support rails and directly in contact with the heddle support rails. Although this solution is functional, the movability of the heddles is significantly restricted through the use of such damping elements. This leads to the fact that the heddles cannot easily keep up with the changing positions of the warp threads. Stripes in the warp are thus the unwanted result. Moreover, it is very difficult to mount heddles on the shafts and to repair broken warp threads since heddles must be thereby moved to do so.

Such disadvantages are also mentioned in German published application 199 62 977 disclosing the fastening of damping elements on the shaft in such a manner that the outer end of the heddles can make contact with such damping elements before the heddles are pulled by the heddle support rail. The drive for the heddle occurs then, according to such an approach, via the damping elements and not via the heddle support rails. However, it is extremely difficult to determine the appropriate spacing between the end of the heddle and the damping element. Since the heddles are no longer pulled by the heddle support rail as usual, but according to this prior art approach are pushed by the damping elements, the position of the heddle becomes unstable and they then have the tendency to turn sideways. This may be relatively harmless depending on the existing weaving conditions but it could possibly lead to unwanted stripes in the warp or the heddles might become wedged between the two heddle support rails of the shaft. The consequences are that the warp thread may break and oftentimes the heddles themselves may break as well.

SUMMARY OF THE INVENTION

It is the object of the present invention to avoid the aforenoted disadvantages and to provide a system of heddles with damping or cushioning elements that permit proper operation of the loom shaft even at high weaving machine speeds and preferably utilizing loom shafts of traditional design.

In accordance with the invention, at least one of the two end eyes of the heddle has a cutout in the longitudinal direction of the heddle in such a manner that even during operation and bending of the loom shaft in the region of the shaft center, the distance between an inner rail edge of a support rail in the vicinity of such one eye and an outer rail edge of the other of the support rails is greater than a distance between the inner stop shoulder of the one end eye and an outer stop shoulder of the opposite eye.

It is further object to provide the inner edge of the heddle support rail of elastic material on at least one support bar of the loom shaft.

A heddle is provided according to the invention that deviates from the norm and allows swaying of the loom shafts without making contact of the inner edge of the heddle support rail with the heddles themselves. Additionally, the damping or cushioning is provided in such a manner that it prevents over-shooting of heddles relative to the heddle support rails and thereby the heddles may preferably be exchanged in an easy manner. The latter is of significance since the damping element inevitably becomes a worn part and has to be replaced from time to time.

In accordance with the invention, the end eyes of the heddles are shaped and dimensioned as they are known from the ISO Standards 11677-1 and 11677-2. Compared to heddles designed in such manner, the heddles of the invention are provided with free play at both end eyes extending in the direction of the thread eye located approximately at the heddle center. The inner sides of the end eyes have been without any significance up till now. During the aforementioned stresses, however, heddles may hit against the inner side of the heddle support rail in cases when shafts are bent near the center. Such bending is no longer unusual under today's operational conditions; on the contrary, they are the rule. As a result, heddles rebound from the heddle support rail and hit again against the heddle support rail with the opposite end eye. The consequences are high wear on the heddles and the heddle support rails, breaking of heddles in the region of the end eyes and contamination or soiling of the textile fabric by worn-off metal particles from the heddles and the heddle support rail. A part of the problem is resolved by the additional free play in the region of the end eye extending toward the heddle center. The total free play between the heddle support rail and the inner side of the respective end eye is enlarged as mentioned above. Compared to the standard, which is defined in the above-mentioned publication of Standards, this means that for example, an enlargement of 0.5 to 2 mm. For highly rigidly designed shaft constructions, there is preferably selected a measurement of 0.5 to 1 mm, which means, that the total measurement of the aforementioned Standards for C-shaped heddles is increased to 27.5 to 29.5 mm, for J-shaped heddles to 19 to 21 mm. And, for O-shaped heddle end eyes, which are not defined in the aforementioned Standards, the corresponding measurement would amount to 15.5 to 17.5 mm. By providing the additional free play, it can already be prevented in many cases that the heddle can hit the inner side of the heddle support rail. This is assisted by the tension of the warp threads that extends through the thread eye of the heddle since this tension effects the movement of the heddle by slowing down its speed.

In an additional step of the invention, there were precautions taken whereby the inner side of the end eyes remains undamaged. Such end eyes come into contact with the heddle support rail during acceleration of the heddle. It is particularly prevented that the heddles oscillate between the two heddle support rails of the shaft, which is caused by the jerking acceleration of the heddles whereby they alternatively hit one or the other heddle support bar. In such cases where the tension of the warp thread is not enough to sufficiently dampen the heddle movement, it can be achieved in most cases that the aforementioned disadvantages or difficulties are reduced to an acceptable level through reduction of play between the heddles and the heddle support rail to 1 to 1.5 mm, for example, which normally lies between 2 and 4 mm.

However, there are known instances in which these measures alone are insufficient to achieve normal operational conditions. For this reason, it is an objective of the invention to attach damping elements at a distance away from the heddle ends of at least one shaft, preferably on two shafts, so that the free movement of the heddles between the two heddle support rails, which is determined by the measurements of the shaft and the heddle, is limited to 0.5 to 1 mm, for example. In specific cases, it may also be necessary to limit the free movement to less than 0.5 mm. The necessary amount is influenced by the operational conditions of the weaving machines and the particular item to be woven.

The damping element added in accordance with the invention may be made of a relatively hard, rubber-like elastic material. The hardness should amount to more than 80 Shore, preferably 90 to 95 Shore. The damping elements may be designed in such a manner as to be snapped onto to a projection provided on the shaft profile. This allows a simple exchange in a time saving manner of the damping element worn down during operation and may be installed without the use of tools. The cross-section of the damping element, which may be attached by snapping, may change in shape in a manner whereby the aforementioned limitation of free movement of the heddle can be controlled according to needs and whereby the full cross-section is to be provided. Since the damping elements are interchangeable, damping elements having varying cross-sectional shapes can be provided and thereby experiment with a varying degree of free movement to identify the optimum operating point.

The mounting element is preferably designed as a projection. However, it is also possible to design the mounting element in the form of a groove. The mounting element, which is to be pushed into the groove for attachment, is in such case, formed on the damping element itself and the function of the damping element remains the same as aforementioned. The design of such a mounting element on the support bar of a loom shaft is very simple whereby the support bar is made of aluminum. The mounting element is formed during extrusion as part of the profile. The machining of such a mounting element may not be so easy in shafts that are made of steel parts or in shafts made entirely or partly of fiber-reinforced synthetic material. In cases where support bars are made of aluminum, there can be reasons for not extruding a holding element on the support profile, for example, the attachment of an intermediate brace. In such cases, a separate support element made of light material, preferably synthetic material, is fastened to the shaft preferably by gluing. This support element is shaped to fit the respective support bar and is provided with a projection or groove in the same manner as aforedescribed and it serves thereby as a mounting element for the damping element of the invention. As a whole, the invention has the effect that a heddle has been provided that is pulled by the heddle support bar when it has to be accelerated, and it is thereby provided with a stabilized position and does not tend to turn sideways. The novel heddle according to the invention can freely oscillate between the two heddle support rails at jolting accelerations so that the inner sides of the end eyes do not come into contact with the heddle support rails, not even then when the distance between the heddle support rails is considerably decreased by the bending of shafts since the damping element comes into action at this point. Moreover, the thusly created heddle cooperates with the damping element, according to the invention, by the change and the shape of the end eye of the heddle whereby wear of heddles and heddle support rails is radically decreased. As a result, the operational life of heddles and shafts are increased and production stops are avoided during weaving.

Independent of the design of the end eyes of the heddles and the heddle support rails for further use, it is advantages according to the invention that the two end eyes be provided with free movement in the direction toward the thread eye surpassing the degree of movement relative to the heddle support rail as defined in the Standards and surpassing mere functional necessity. The inventive cooperation of the novel heddle and damping element is only made possible by the aforedescribed arrangement. The heddle according to the invention may be also employed without a damping element, if the tension of the warp thread running through the warp eye is sufficiently high. In such case, it may be that the end eye, which has not been in contact with the heddle support rail originally and which is the end eye opposite the end eye taking up the acceleration of the heddle, comes into contact with the opposite heddle support rail. Under such circumstances, this may be sufficient to ensure acceptable operation of the weaving machine. In a preferred version of an inventive embodiment, the system of the damping element will always be employed since a noise-reducing effect is additionally achieved through the use of the damping element. However, since the damping elements do wear down inevitably with time, and any rubbed-off material particles fall, at least partly, onto the warp threads, there are some woven fabrics for which the employment of damping elements is highly undesirable due to such contamination. It is therefore an additional advantage of the novel heddle in that it may also be employed together with loom shafts on which the attachment of the damping element is not possible for geometrical reasons or where it is unacceptable based on its contamination, and a wear-reducing effect is still achieved.

Other objects, advantages, and novel features of the invention will become more apparent from the following detailed description of the invention when taken in conjunction with the accompanying drawings.

DETAILED DESCRIPTION OF THE INVENTION

Figure 1:
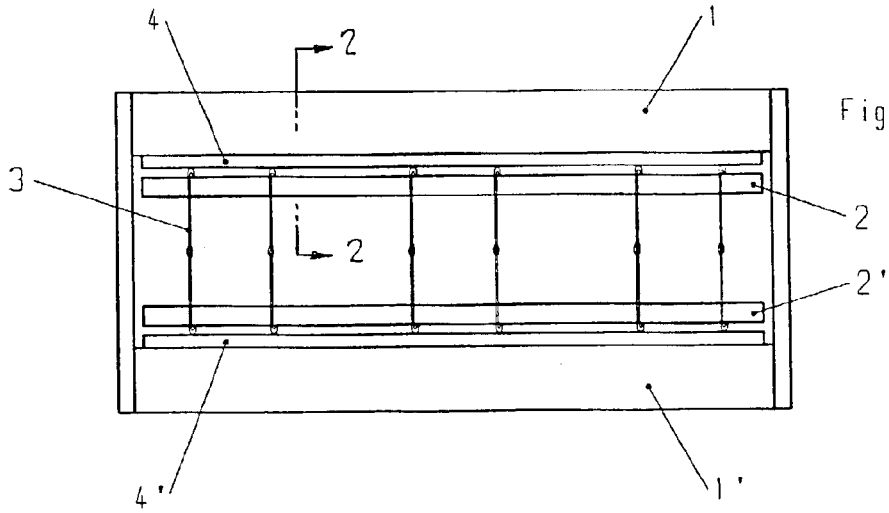
FIG. 1 is a front schematic view of a loom shaft with support bars, heddle support rails and heddles.
Figure 2:
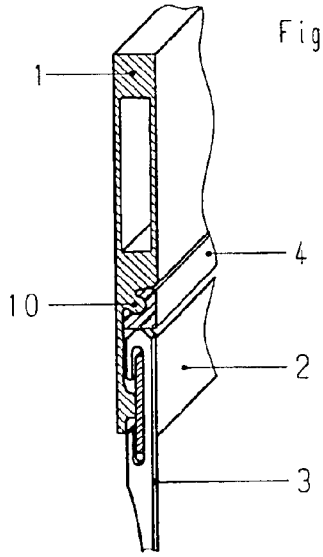
FIG. 2 is a sectional view taken substantially along the line 2—2 of FIG. 1, showing one embodiment of the damping element connected to the support bar profile of the shaft.

FIG. 1 is a schematic illustration of a loom shaft with upper and lower support bars 1 and 1', heddle support rails 2 and 2' respectively connected to the support bars, heddles 3 lined up on the heddle support rails, and a pair of damping elements 4 and 4' respectively connected to the support bars for the purpose and in the manner as to be more detailed hereinafter. FIG. 2 shows one embodiment of damping element 4 connected to support bar profile 1 of the loom shaft. The damping element is secured in place by the provision of a holding element 10 designed as a component of support bar profile 1. Damping element 4 may thereby be detachably snapped onto holding element 10, the damping element being made of a rubber-like elastic material, and having an elongated groove into which elongated holding element extends. The end eye of heddle 3 and heddle support rail 2 are illustrated in FIG. 2. And, as mentioned above, the holding element 10 is in a form of a projection.

Figure 3:
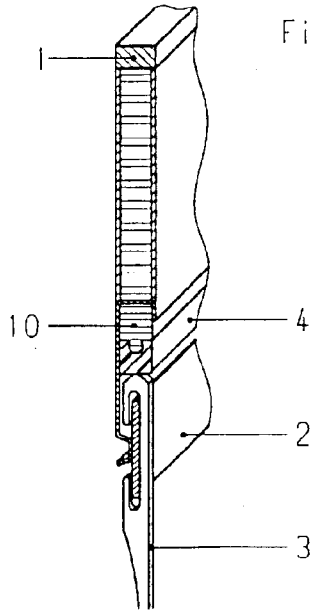
FIG. 3 is a view similar to FIG. 2 of another embodiment of a support bar profile of the shaft.

FIG. 3 is a view similar to FIG. 2 of another embodiment of support bar 1 having connected thereto a separate holding element 10 which includes a projection which extends into an elongated groove of the damping element to be thereby snapped into place in a similar manner as described with reference to FIG. 2.

Figure 5:
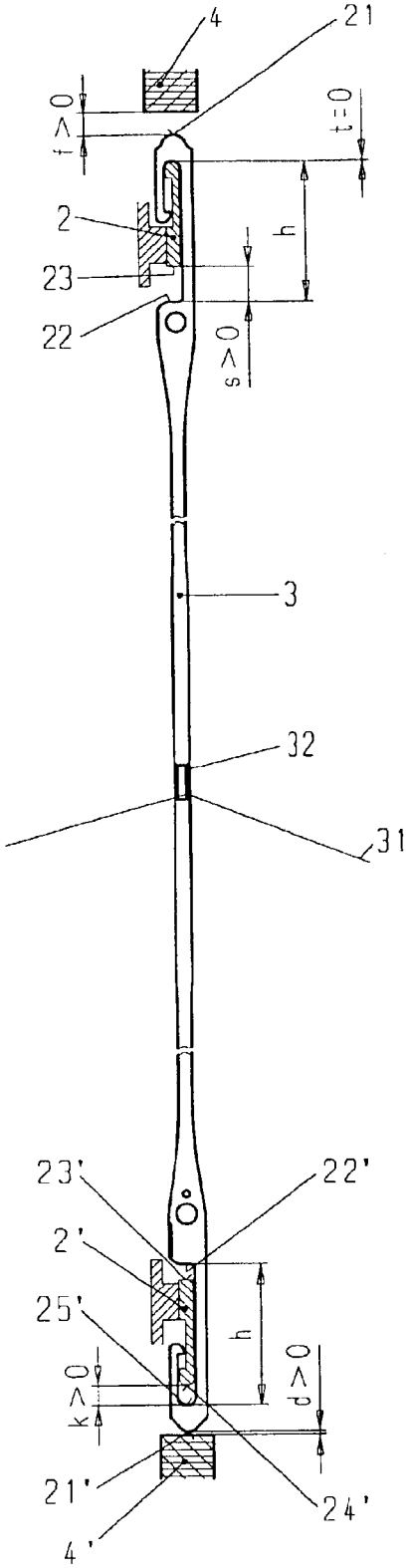
FIGS. 4 and 5 are views of the heddle designed according to the invention having J-shaped end eyes.
Figure 4:
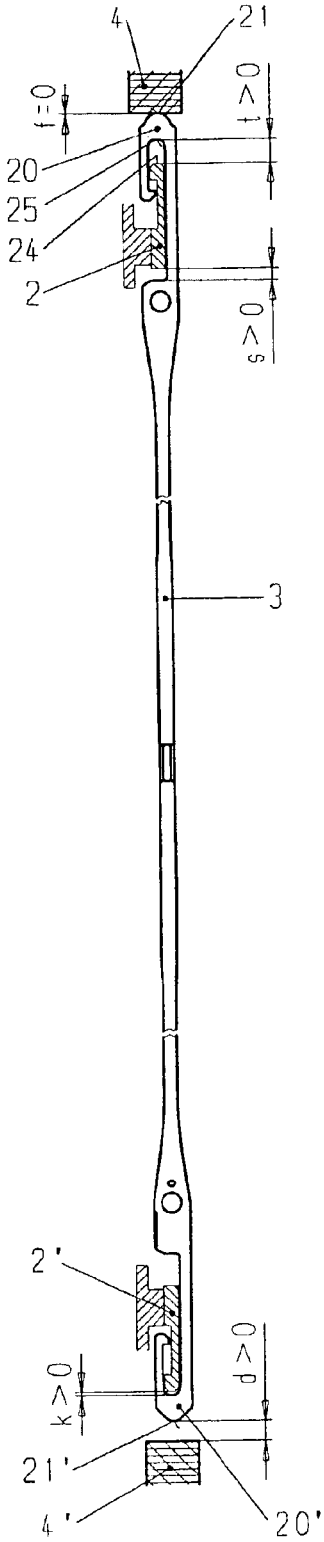

FIGS. 4 and 5 show heddles having J-shaped end eyes. FIG. 4 schematically shows the cooperation of heddle 3 as designed according to the invention together with heddle support bars 2 and 2', and damping elements 4 and 4', designed according to the invention. In the FIG. 4 position, upper outer end 21 of end eye 20 of heddle 3 contacts damping element 4 whereby distance f becomes 0. Remaining are the distances s, t, d, and especially k, which all remain greater than 0. This shown position is reached when the moving heddle in the breaking phase of the shaft movement is at a faster movement than the shaft itself and shoots past the end position.

In this position, the two heddle support rails 2 and 2' are closer to one another than in the idle position based on the elastic deformation of the shaft, which has the result that value k is greater than 0.

The end position, which means a dead stop, is reached when the distance t becomes 0 and the distances f, s, k and d are all greater than 0.

FIG. 5 likewise shows the cooperation of heddle 3 with heddle support rail 2, according to the invention, during the acceleration phase of the shaft and the heddle. The damping element 4 of the invention does not come into action in this phase. The distance t is 0 in this phase, and the distances f, k, s and especially d are all greater than 0.

This position corresponds also to the dead stop of the shaft and the heddle in the upper shed position of the shaft. The heddle 3 is actually pulled against the heddle support rail 2 in this position through the tension of the warp thread 31 running through thread eye 32. The distance of the heddle support rail is now again in the present status, which leads to the result that distance d is greater than 0 even though t is equal to 0 on the opposite heddle support rail.

Figure 7:
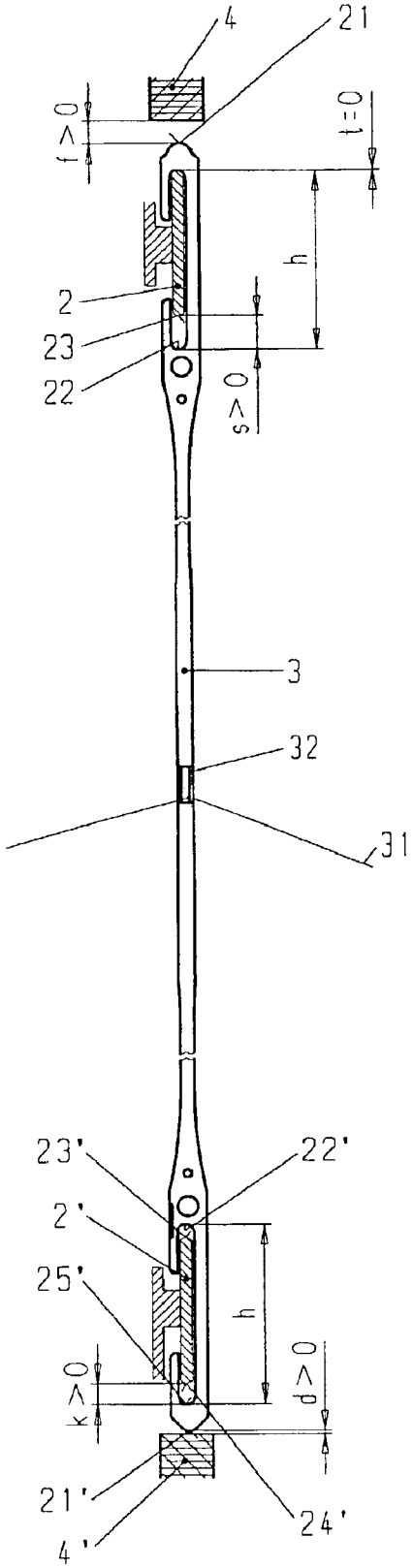
FIGS. 6 and 7 show a heddle designed according to the invention having C-shaped end eyes.
Figure 6:
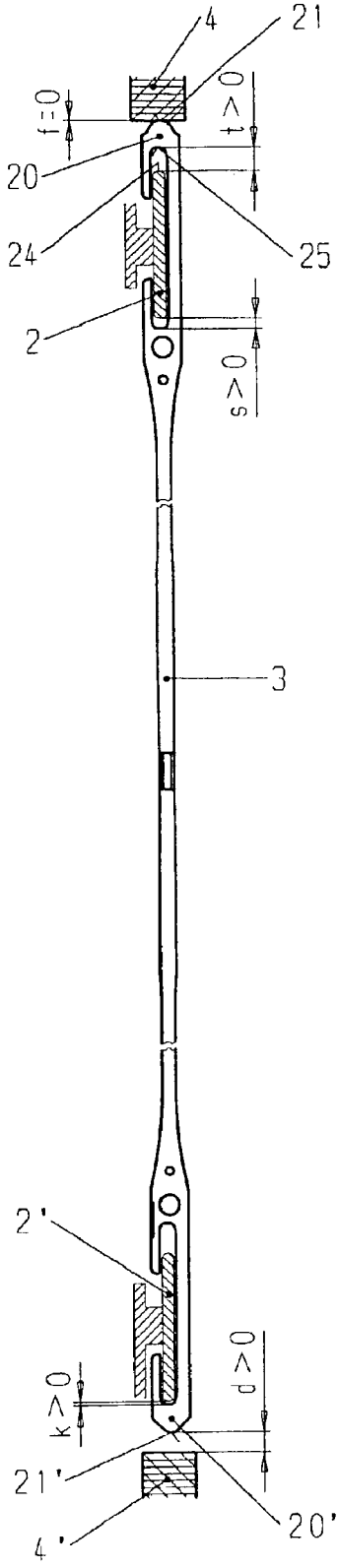

FIGS. 6 and 7 show positions of the heddle analogous of that shown in FIGS. 4 and 5. However, in this case, it includes heddles with C-shaped end eyes and correspondingly shaped heddle support rails.

Figure 9:
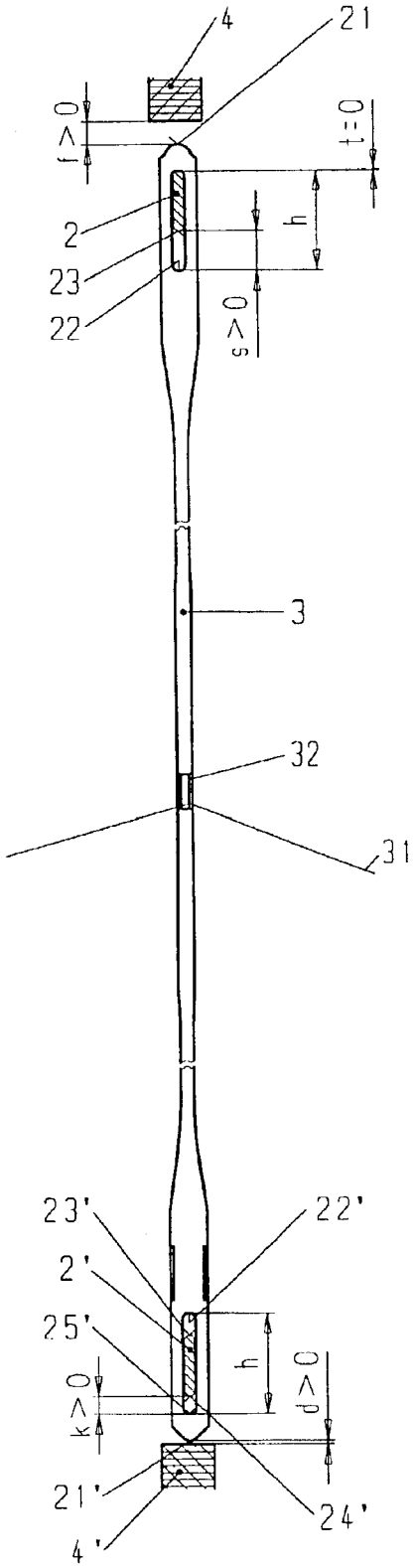
FIGS. 8 and 9 show a heddle designed according to the invention having O-shaped end eyes.
Figure 8:
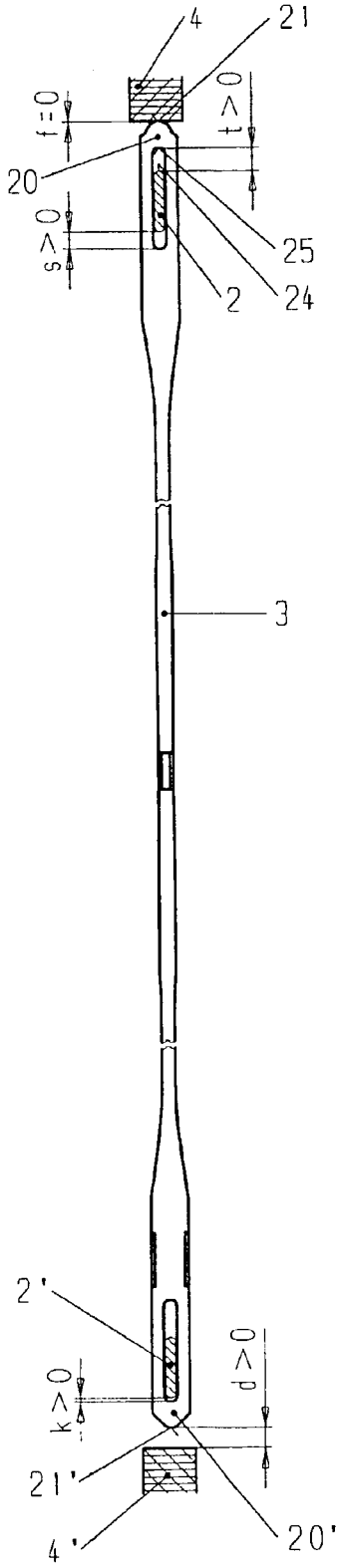

FIGS. 8 and 9 shows positions analogous to the ones in FIGS. 4 and 5, or in FIGS. 6 and 7. However, FIGS. 8 and 9 include heddles with O-shaped end eyes and correspondingly shaped heddle support rails.

A comparison of the respective FIGS. 4, 5 or 6, 7 or 8, 9 clearly show the invention as well as a relation to dimensioning of the individual heddles and as well as in relation to the arrangement and dimensioning of the damping elements.

Regarding the design of the end eye, it is essential that distance s is always greater than 0 whenever value k equals 0, which means that this occurs when the end eye on the opposite end of the heddle contacts outer edge 24' of support rail 2'. This applies to both end eyes, which means that inner edge 22 or 22' of both end eyes oriented toward the heddle center contacts heddle support rail 2 or 2' but never inner edge 23 or 23'. This is also true in the case when heddle support rails 2 and 2' lie closer to one another based on the deformation of the shaft, as illustrated in FIGS. 4, 6 and 8.

It is important relative to damping elements 4 or 4' that they are only contacted or pushed by heddle ends 21 or 21' when the heddle supports lie close to one another based on the elastic deformation of the shaft, which is again illustrated in FIG. 4. The contact of heddle end 21 of damping element 4, as shown in FIG. 4, occurs when value k is greater than 0, which means that outer stop 25' of heddle eye 20' does not come into contact with outer edge 24' of heddle support rail 2'.

Both aforementioned measures lead to the fact that wear on the heddle support rail and also on the heddle is extremely low, as required by the invention.

By comparison, FIG. 5 shows two heddle support rails in the so-called "idle position", which means at a distance apart according to the initial starting position. However, this leads to the fact that opposite end 21' of heddle 3 is lifted away from damping element 4' during engagement of heddle support rail 2 with outer stop element 25 of end eye 20, which is represented in that the value d is greater than 0. It is thereby made obvious that at low stress of the shaft or at low operating speeds during which almost no deformation of the shaft occurs, the heddles practically never come into contact with the two damping elements 4 and 4'. Nevertheless, wear under these operating conditions is also very little so that overshooting of the heddle almost never occurs and damping may therefore not be necessary.

Figure 10:
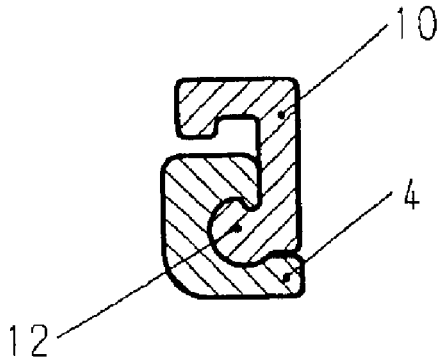
FIG. 10 is a sectional view of one embodiment of a holding element for holding a damping element.

FIG. 10 shows an embodiment of the shape of a holding element 10 in cross-section having a stud-shaped projection 12 designed and manufactured independently from the support profile of the shaft. Damping element 4 is detachably snapped onto projection 12.

Figure 11:
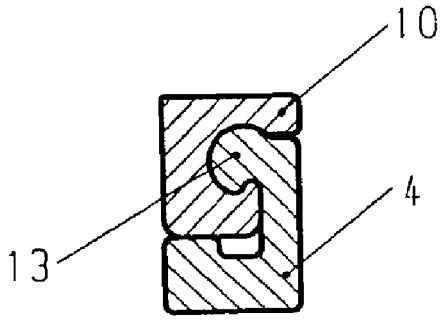
FIG. 11 is a sectional view of another holding element embodiment.

FIG. 11 shows another embodiment of a holding element 10 in cross-section having a groove-shaped depression 13, which is also independently designed and manufactured from support profile of the shaft. A matching projection of the holding element 4 is detachably snapped into such groove.

Obviously, many other modifications and variations of the present invention are made possible in the light of the above teachings. It is therefore to be understood that within the scope of the appended claims the invention may be practiced otherwise than as specifically described.

What is claimed is:

1. A loom shaft comprising a heddle frame of upper and lower support bars, upper and lower heddle support rails attached to the support bars and heddles lined up on the heddle support rails, each heddle having two end eyes, at least one of the eyes being formed as an elongated opening extending in a longitudinal direction of the heddle in a manner that, even during operation and bending of the shaft in a region of a central area of the shaft, a distance between an inner rail edge of one of the support rails in the vicinity of said one eye and an outer rail edge of the other of the support rails is greater than a distance between an inner stop shoulder of said one end eye and an outer stop shoulder of the opposite eye, said loom shaft further comprising a strip of elastic material connected along said one of said support bars adjacent an inner edge thereof, said elastic material being engageable by an end portion of said heddle in which said end eye is formed to damp movement of said heddle during operation of said loom shaft.

2. The loom shaft according to claim 1, wherein both of the end eyes have elongated openings extending in the longitudinal direction of the heddle.

3. The loom shaft according to claim 1, wherein, at a preset position of the shaft, the distance between an inner edge of the elastic material and the outer rail edge of the other of the support rails, is greater than the distance between an outer stop shoulder of the heddle in the vicinity of the elastic material and an outer stop shoulder of the opposite eye, and the distance is smaller between the inner edge of the elastic material and the outer rail edge of the other of the support rails than the distance between the outer stop shoulder of the one heddle eye and the outer stop shoulder of the opposite eye during an elastic deformation of the shaft while the heddle support rails are closer to one another in the region of the center of the shaft.

4. The loom shaft according to claim 1, wherein a strip of elastic material is connected along each of the support bars adjacent an inner edge thereof.

5. The loom shaft according to claim 1, wherein at least one of the two end eyes of the heddle is sized in a longitudinal direction that between a side of the heddle support rail with which the one eye is associated and a confronting side of the one end eye there is a free play gap whereby the size of the one end eye in the longitudinal direction is a minimum of 19 mm and a maximum of 21 mm for a J-shaped heddle end eye, is a minimum of 27.5 mm and a maximum of 29.5 mm for a C-shaped heddle end eye, and a minimum of 15.5 mm and a maximum of 17.5 mm for an O-shaped heddle end eye.

6. The loom shaft according to claim 1, wherein at least one damping element is connected along an inner edge of one of the support bar facing a heddle support rail, the dampening element comprising a rubber-like elastic material having a Shore hardness greater than 80, the damping element being snap fitted to a mounting element on the one support bar, and the damping element being dimensioned such that the opposite end eye is at least spaced away from the opposing heddle support rail during operation of the heddle and during contact of an outer end of the heddle with the damping element.

7. The loom shaft according to claim 5, wherein the end eye is J-shaped and the free play measures at least 5.2 mm relative to the fitted heddle support tail.

8. The loom shaft according to claim 5, wherein the end eye is C-shaped and the free play measures at least 5.2 mm relative to the fitted heddle support rail.

9. The loom shaft according to claim 5, wherein the end eye is O-shaped and the free play measures 6.5 mm relative to the fitted heddle support rail.

10. The loom shaft according to claim 6, wherein the damping element is detachably snapped into a groove extending longitudinally along the inner edge of the one support bar.

11. The loom shaft according to claim 6, wherein the inner edge of the one support bar has a longitudinally extending projection in snap fitting engagement with a longitudinally extending groove of the damping element.

12. The loom shaft according to claim 11, wherein the projection is integral with the support bar.

13. The loom shaft according to claim 11, wherein the projection is formed on a separate element attached to the support bar.

14. A method for the operation of the loom shaft according to claim 1, comprising, operating the shaft in such a manner that in a preset position the distance between the elastic inner edge of the support bar and the outer edge of the heddle support rail arranged on the opposite support bar, the distance between the outer end stop of the heddle in the region of the elastic inner edge and the outer stop of the heddle end eye in the region of the opposite support bar and the heddle support rails, which closer to one another in case of occurring elastic deformation of the shaft at high stress on said shaft, and the distance in the region of the shaft center between the elastic inner edge of the support bar and the outer edge of the heddle support bar arranged on the opposite bar are smaller than the distance between the outer end stop of the heddle in the region of the elastic inner edge and the outer stop of the heddle end eye in the region of the opposite support bar.

* * * * *